United States Patent [19]

Murray

[11] 3,930,447

[45] Jan. 6, 1976

[54] DUAL PURPOSE DISPLAY FOR PRINTING PRESSES

[75] Inventor: James E. Murray, University Heights, Ohio

[73] Assignee: Harris Corporation, Cleveland, Ohio

[22] Filed: July 22, 1974

[21] Appl. No.: 490,271

[52] U.S. Cl. ..... 101/365

[51] Int. Cl.[2] ..... B41F 31/04

[58] Field of Search ..... 101/365; 340/324 A, 163; 315/8.6

[56] References Cited

UNITED STATES PATENTS

| | | | |
|---|---|---|---|
| 2,968,988 | 1/1961 | Crosfield | 101/365 X |
| 2,969,016 | 1/1961 | Crosfield et al. | 101/365 X |
| 3,057,294 | 10/1962 | Jameson | 101/365 |
| 3,185,088 | 5/1965 | Norton | 101/426 |
| 3,343,030 | 9/1967 | Dragon et al. | 315/22 |
| 3,376,426 | 4/1968 | Frommer et al. | 250/226 |
| 3,474,438 | 10/1969 | Lauher | 340/324 |
| 3,487,308 | 12/1969 | Johnson | 324/140 |
| 3,567,923 | 3/1971 | Hutchison | 101/350 UX |
| 3,588,696 | 6/1971 | Solvay | 250/549 |
| 3,702,587 | 11/1972 | Lee | 101/365 X |
| 3,707,123 | 12/1972 | Heasman | 101/207 |
| 3,746,957 | 7/1973 | Forster | 318/696 |
| 3,792,659 | 2/1974 | Albrecht | 101/365 |
| 3,835,777 | 9/1974 | Krygeris | 101/350 |

FOREIGN PATENTS OR APPLICATIONS

| | | | |
|---|---|---|---|
| 897,186 | 5/1962 | United Kingdom | 101/365 |
| 925,798 | 5/1963 | United Kingdom | 101/365 |

*Primary Examiner*—J. Reed Fisher

[57] ABSTRACT

A display apparatus for facilitating adjustment of a printing press displays several quantities related to the inking of the printing press in a display that is arranged to show a functional relationship between the quantities. The settings of a plurality of ink adjustment devices are shown in a linear array of setting displays that are arranged in the same order as the adjustment devices are arranged across the width of the press. Each setting display comprises a column of equally-spaced dots with an interpolation dot at the end of the column. In vertical alignment with and in appropriate lateral relationship with that display of settings, a further display is provided showing deviations of the printed ink density from set points representing proper ink density. Each deviation display corresponds to a lateral portion of the press whose printed ink density is controlled by the settings of those of the adjustment devices with whose setting display it is aligned.

7 Claims, 7 Drawing Figures

DUAL PURPOSE DISPLAY FOR PRINTING PRESSES

BACKGROUND OF THE INVENTION

The present invention relates to printing presses, e.g. a lithographic printing press having an ink fountain, and relates in particular to apparatus for displaying the performance of a printing press to an operator for purposes, for example, of adjusting the press. In the prior art, printing presses commonly have been made employing a plurality of ink rate adjustment devices, such as ink keys distributed laterally across the width of the press, to adjust the rate at which ink is supplied to various lateral portions of the rolls of the press, and therefore to the paper being printed. One such system displays simultaneously the settings of all of the ink control devices of a printing unit, with the settings displayed side by side in the same order as the ink control devices themselves are arranged across the width of the printing press, and with an interpolating dot at the end of each setting display when appropriate, but not in combination with a density deviation display as herein.

Printing presses have been equipped in the past with optical densitometers that measure the reflection density of printed areas on the paper to monitor the ink density. A densitometer of this type is disclosed in U.S. Pat. No. 3,756,725 issued Sept. 4, 1973, made a part hereof by reference, in which presettable reference levels are provided for automatic comparison with reflection density readings that are made by the densitometer. In still other equipment of the prior art, analog strip chart recorders have been connected with the printing presses to record traces of deviations of densitometer measurements from predetermined set points; these charts give the user a visual indication of a number of recent measurements of reflection density.

SUMMARY OF THE INVENTION

In one aspect of the present invention the ink supply of a printing press is controlled by ink rate control devices such as ink keys, which are distributed laterally across the width of the press, and the press is equipped with display apparatus. The ink rate control devices are adjustable and their settings are sensed by feedback devices which transmit signals to the display apparatus, where the settings are displayed side by side in the same order as the ink rate control devices are distributed across the press. The printing press also has at least one system for measuring the optical reflection density of ink printed by the press. The amount by which the measured ink density deviates from a predetermined reference level is displayed. This display of density deviation is geometrically aligned with respect to the display of settings of the ink rate control devices, in such a way that its lateral position indicates which ones of the ink rate control devices affect the ink density that is being measured.

For example, in a specific embodiment of the invention, a printing press, which has several printing units operated in series for printing different colors successively on the same paper, has a dual purpose display which, by switching, can be employed to display the performance of one at a time of the printing units. The settings of the ink adjustment keys of the selected printing unit are displayed on an upper portion of the face of a cathode-ray tube (CRT). A lower portion of the face of the CRT displays the deviations of the readings of several ink densitometer channels from their respective pre-established density reference levels. Each density deviation is displayed in a horizontally aligned position on the CRT face beneath the setting displays for the particular ink keys which control the ink that is measured respectively by each of the densitometers.

Each of the key setting displays comprises a column of uniformly spaced dots and, when appropriate, and interpolation dot at the end of the column.

Other aspects of the invention are apparent hereinbelow and in the figures.

DESCRIPTION OF A PREFERRED EMBODIMENT

Figure 1:
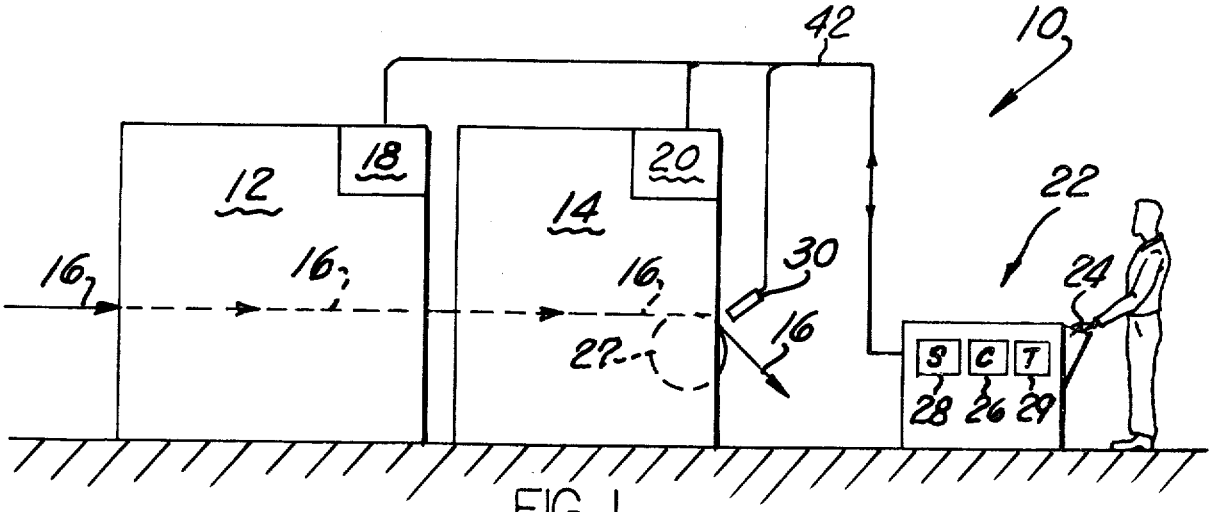
FIG. 1 is a two-unit printing press equipped with a dual purpose display in accordance with the present invention.

A printing press 10 equipped with a preferred embodiment of the invention has two printing units 12, 14 for printing two colors of ink on paper 16 or other stock that passes through the press, FIG. 1. Each of the printing units 12, 14 has an ink fountain 18, 20 respectively, which supplies printing ink at controlled rates to rolls of the press.

For the convenience of the operator in examining the printed paper 16, an inspection table 22 is provided. The inspection table 22 has a run and display panel 24, a computer 26, a set-up panel 28, and a tape input device 29, which are described further hereinbelow. Several densitometer heads 30 are arranged across the press near a press cylinder 27 to measure the optical reflection density of the printed product 16 at the output of the second printing unit 14.

Figure 2:
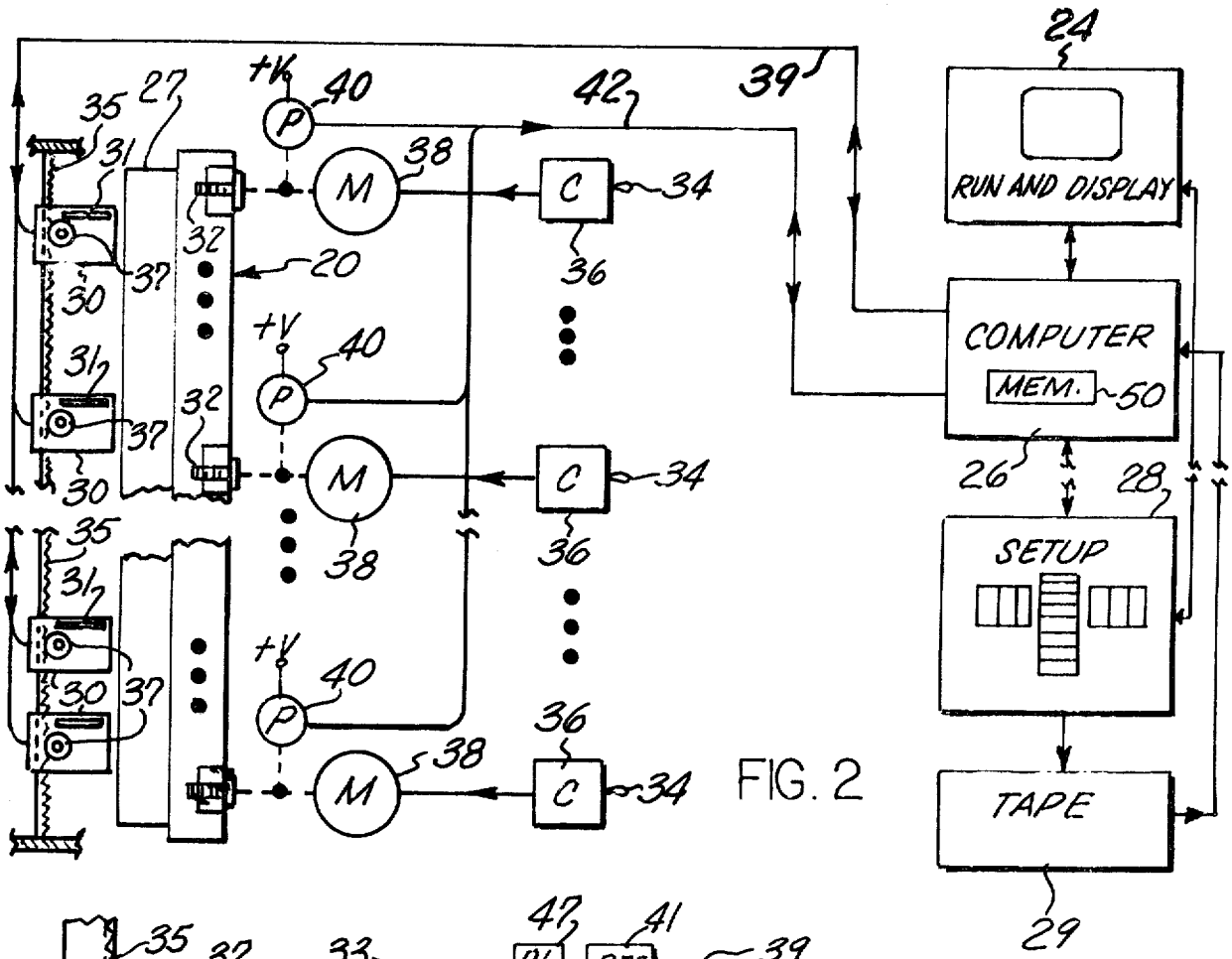
FIG. 2 is a schematic block diagram of some portions of the printing press that are related to the present invention.

Each ink fountain, for example, fountain 20, is at least as wide horizontally as the width of the paper 16 being printed, and is equipped with a great number of ink supply rate control devices, e.g. conventional screwthreaded ink keys 32, deployed at various lateral positions across the conventional fountain 20 as shown schematically in FIG. 2. Each of the ink keys 32 is adjustable by remote control, by a respective remote adjustment switch 34, a control circuit 36, and a bidirectional motor 38. When one of the switches 34 is operated, its control circuit 36 energizes the motor 38 to rotate the respective ink key 32 and thereby adjust the thickness of ink film that is being delivered by the ink fountain 20, in the neighborhood of that particular ink key, to a respective lateral portion of the printing unit 14. Any conventional manner of moving the ink keys can be used; the particular manner of moving the keys is not part of this invention.

Figure 3:
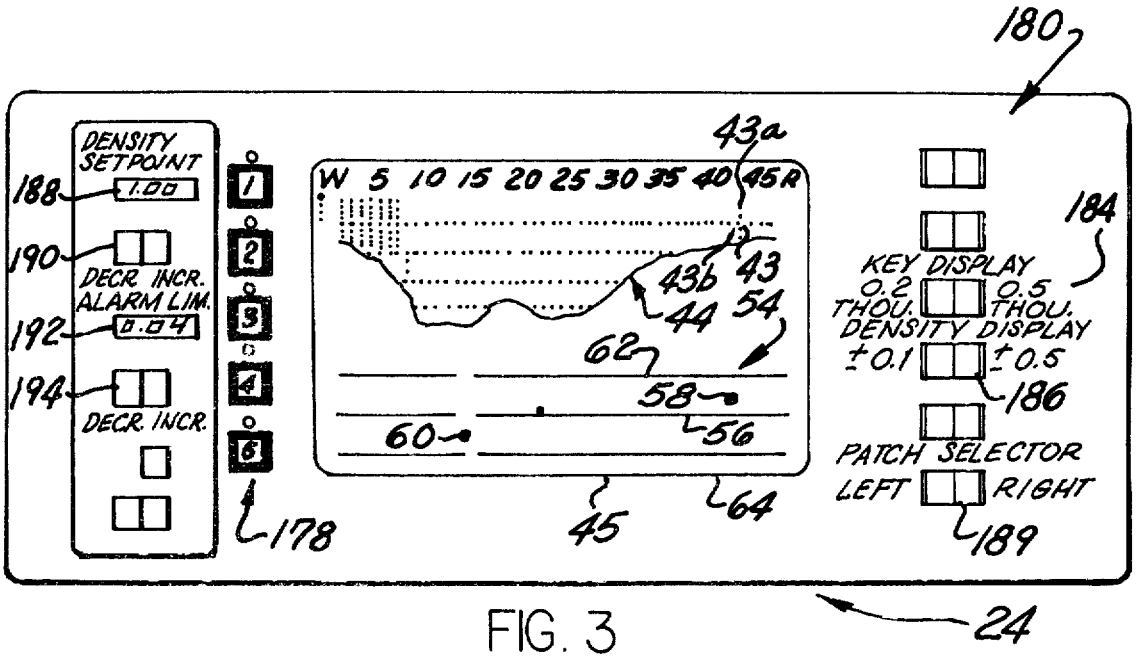
FIG. 3 shows the dual purpose display and some controls for a preferred embodiment of the invention, for use by the operator principally while the press is running.

The setting of each ink key 32 is sensed by a potentiometer 40 whose transfer arm tracks the position of the associated key 32 so as to provide an electrical position signal. A printing press with remotely controlled ink keys and potentiometer feedback to a display is disclosed in U.S. Pat. No. 3,057,294, K. Jameson, "Inking System for Printing Machines," issued Oct. 9, 1962. The position signal from the ink key is conducted on a cable 42 to the computer 26, as shown in FIG. 2, and from there is transmitted to the run and display panel 24, which provides visual displays of the settings of all of the ink keys 32 simultaneously. As shown in FIG. 3, displays 44 of the ink key settings are ordered from left to right on an upper portion of the face of a CRT 45 in this embodiment. For each of the horizontally arrayed key position displays 44, for example a display 43, a vertical distance from a highest dot 43a at the top of the display, measured downward to the lowest dot 43b of a series of vertically aligned dots, represents the approximate ink film thickness established by the forty-third ink key.

Figure 2A:
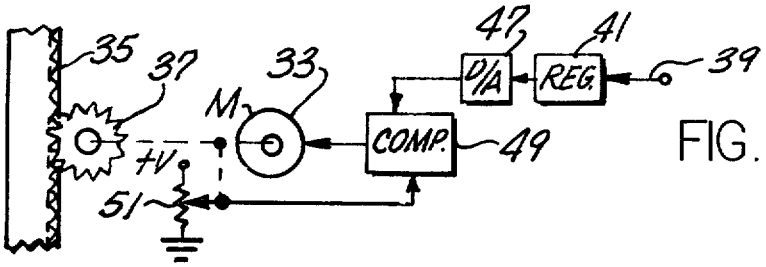
FIG. 2A is schematic block diagram of a portion of a densitometer head for positioning the densitometer head.

In the embodiment being described, four densitometer heads 30 are located at laterally adjustable positions across the width of the paper, as shown in FIG. 2. Each head 30 can be moved to desired lateral positions by a respective bi-directional gearhead motor 33. The positioning portion of equipment in a densitometer head 30 is shown in FIG. 2A. A stationery rack gear 35 is engaged by a pinion 37 that is driven by the motor 33. The computer 26 transmits position command data on conductors of a multi-purpose cable 39 to a data storage register 41, and the data is converted to a analog signal by a digital-to-analog converter 47. A comparator 49 receives this resulting analog signal and compares it with a signal indicating the actual position of the densitometer head 30, the actual position signal being obtained from the armature of a potentiometer 51 that is driven through appropriate gearing by the motor 33. A difference between commanded position and actual position produces a signal from the comparator 49 to the motor 33 that moves the densitometer head 30 to a correct lateral position.

Each densitometer head 30 may include several densitometer channels 31; i.e., equipment for several density measurement channels 31 can be located together in one head 30. The different channels 31 of one head 30 can be equipped with different color filters for measuring the ink printed by different printing units 12, 14. The channels 31 behave substantially as independent densitometers. FIG. 2 shows only one measurement channel 31 at each of the densitometer heads 30. A suitable densitometer for this purpose is fully described in U.S. Pat. No. 3,756,725.

Each densitometer channel 31 reads the optical reflection density of the printed paper 16 by measuring a flash of light reflected from two areas of the paper onto two photosensitive transducers, and by processing the resulting electical signals. The processed electrical signal of density from each densitometer channel 31 is conducted to the computer 26. The computer in the illustrated embodiment is a model PDP-8/M manufactured by Digital Equipment Corporation of Maynard, Massachusetts, but other computers are also suitable.

A digital density reference signal is stored in advance in a memory unit 50 in the computer 26. This signal is subtracted in the computer from the densitometer signal. The subtraction operation is indicated symbolically by a subtraction block 53 of FIG. 6. The resulting difference signal represents the deviation of the density signal from the reference, which is ordinarily of the nature of an error signal. The sign and magnitude of the deviation signal are then transmitted from the computer 26 to the run and display panel 24, where the deviation forms a display 54 on a lower portion of the CRT 45, FIG. 3. The use of a computer to process data gathered by densitometers on a printing press is shown in copending patent application Ser. No. 324,113, filed Jan. 16, 1973, A. J. Krygeris, "Ink Density Control System."

A positive deviation of a densitometer reading with respect to the reference is displayed as a bright dot (such as a dot 58) displaced vertically above a horizontal base line 56 on the CRT, the distance by which the dot 58 is above the base line 56 being proportional to the magnitude of the density deviation. Conversely, negative deviations are displayed as dots below the base line 56, as illustrated by a display dot 60, which is produced by a different densitometer head 30 than the densitometer head producing the display dot 58.

The display dot 58 is aligned directly below the ink key setting display 43 for the forty-third ink key, as shown in FIG. 3. The optical density deviation indicated by the display dot 58 is affected principally by the settings of the forty-third ink key and several neighboring ink keys on both sides of it. Similarly, the settings, as displayed by the display 44, of perhaps eleventh through the sixteenth ink keys, have the greatest influence on the density deviation displayed by the dot 60 on the deviation display 54. As a result of the alignment of the upper and lower portions 44, 54 of the dual display, it is very convenient for an operator of the printing press to make such ink rate corrections as may be necessary, by remotely controlling the readily identified ink keys that most significantly affect the density deviations that are displayed. Upper and lower horizontal calibration lines 62, 64 are also produced by the cathode ray beam of the CRT 45 to provide a quantitative scale of vertical deflections.

DISPLAY CIRCUITS

Figure 4:
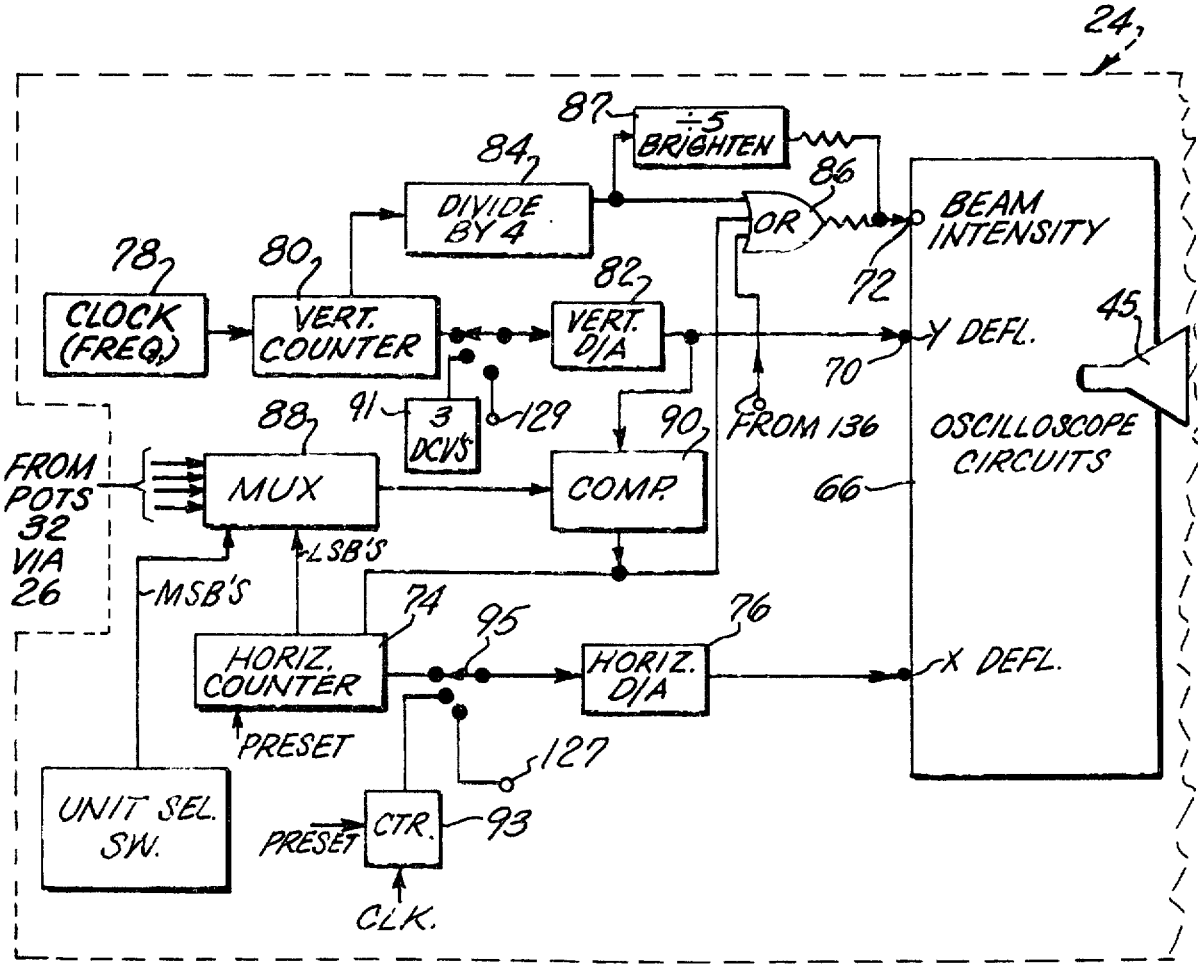
FIG. 4 is a block diagram of electronic equipment for producing an ink key setting display on the upper portion of a CRT face.

All of the displays on the CRT are produced under the control of three electrical signals that are connected to a cathode ray oscilloscope 66, FIG. 4, which is a part of the run and display panel 24. The oscilloscope circuits include the CRT 45, a horizontal deflection amplifier, a vertical deflection amplifier, and miscellaneous circuits such as power supplies. The three controlling signals for the oscilloscope 66 are an X deflection signal, which is applied to an X deflection terminal 68, a Y deflection signal, which is applied to a Y deflection terminal 70, and a beam intensity modulation signal, which is applied to a terminal 72 of the oscilloscope. The X and Y deflection signals control the X and Y coordinates respectively of the CRT beam. As used herein the term beam position refers to the intersection of a path that would be followed by the CRT electron beam with the face of the CRT, regardless of whether the beam is currently turned on or off.

To produce the key position display 44 a horizontal counter 74, FIG. 4, drives a horizontal digital-to-analog converter (D/A) 76, whose output is a staircase voltage connected to the X deflection terminal 68. Each count status of the horizontal counter 74 corresponds to one ink key and to one discrete horizontal position of the beam for the upper display 44. The horizontal counter 74 is incremented by unit pulses that are produced upon each completion of a key display for one key in a manner to be described hereinbelow.

For each key display the CRT beam is swept vertically downward from a uniform base postion at the top of the display 44. To accomplish this a free-running clock 78 produces a train of pulses that are counted in a vertical counter 80, whose output is converted by a vertical digital-to-analog converter 82 into a staircase analog signal for the Y deflection terminal 70. During the vertical sweep the beam is turned on and off momentarily at the base position and upon every fourth count thereafter of the vertical counter 80 as determined by a divide-by-four counter 84, which applies every fourth count through an OR gate 86 to the intensity modulation terminal 72 of the oscilloscope. A divide-by-five counter 87 counts the output pulses of the divide-by-four counter 84 and produces and output signal that is summed with the output of the OR gate 86 to make each fifth display dot of a column brighter then the other dots.

Each vertical trace is terminated when the amount of vertical deflection reaches the value of a feedback signal from the potentiometer 32 that corresponds to the key whose setting is being displayed. The feedback signals from the potentiometers 32 are all connected to an analog multiplexer 88, whose addressing is under the control of the horizontal counter 74. The currently selected analog feedback signal from the multiplexer 88 is connected to one input of a comparator 90, which produces an output pulse when the feedback signal equals the Y deflection signal received at its other input terminal.

Each output pulse from the comparator 90 increments the horizontal counter 74 to the next key position and also turns on the CRT beam through a second input of the OR gate 86 to provide an interpolation dot, for example dot **43*b* of FIG. 3, at the end of the vertical sweep, for key settings that do not happen to coincide with one of the dots from the divide-by-four circuit 84. The multiplexer 88 receives an input signal also from a unit selector switch to select the printing unit whose key position feedback signals are to be examined. To summarize the key setting display, a feedback signal from a key potentiometer 32 is compared in the analog comparator 90 with a progressively increasingly digitally generated vertical staircase deflection voltage. Every fourth count of the counter for the staircase produces a spot of beam intensity during vertical sweeping of the CRT beam. When the vertical staircase signal first exceeds the feedback signal from the pot 32, an extra CRT dot, e.g. dot 43*b* is produced for interpolation at the end of the vertical sweep. The horizontal counter 74** is then incremented to step the CRT beam horizontally rightward to the next key position.

At the left end of the key setting display, which represents the gear side of the press, a press dampener setting is displayed in the same way as the key settings. At the right end of the key display 44 a press ratchet setting is displayed in the same way as the key settings. After the last dot of the ratchet setting display has been produced, the upper display 44 is complete and the lower display is started. Dampener and ratchet displays are optional.

Figure 5:
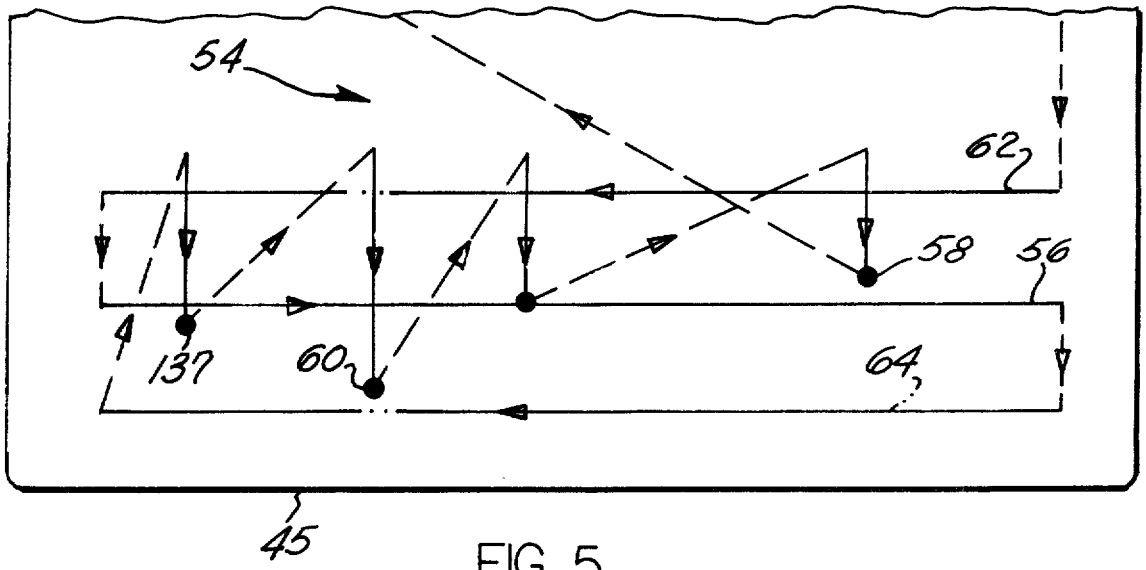
FIG. 5 shows a route of a cathode ray beam position in producing an ink density deviation display on the lower portion of the CRT face.

The lower display consists of two successively generated portions, namely the three horizontal calibration lines, and the density deviation dots. To produce the calibration line display the vertical D/A 82 is switched to a first constant input voltage of a voltage supply 91, this first voltage corresponding to the vertical position of the line 62 as shown on FIGS. 3 and 5, and a decreasing staircase voltage is applied to the horizontal D/A 76 by a preset clock counter 93 through a switch 95. The beam is gated on and is swept horizontally from right to left along the line 62 as seen in FIG. 5. By routine electronic techniques the beam is momentarily blanked and a different voltage is then switched to a vertical D/A 82, after which the restored beam is deflected horizontally to the right to produce the zero line or base line 56. At the right end of the line 56 the beam is again gated off long enough to switch its Y position to the negative calibration horizontal line 64, and the beam is again turned on to produce the line 64 in a trace from right to left. This completes the calibration line portion of the lower display 54.

Figure 6:
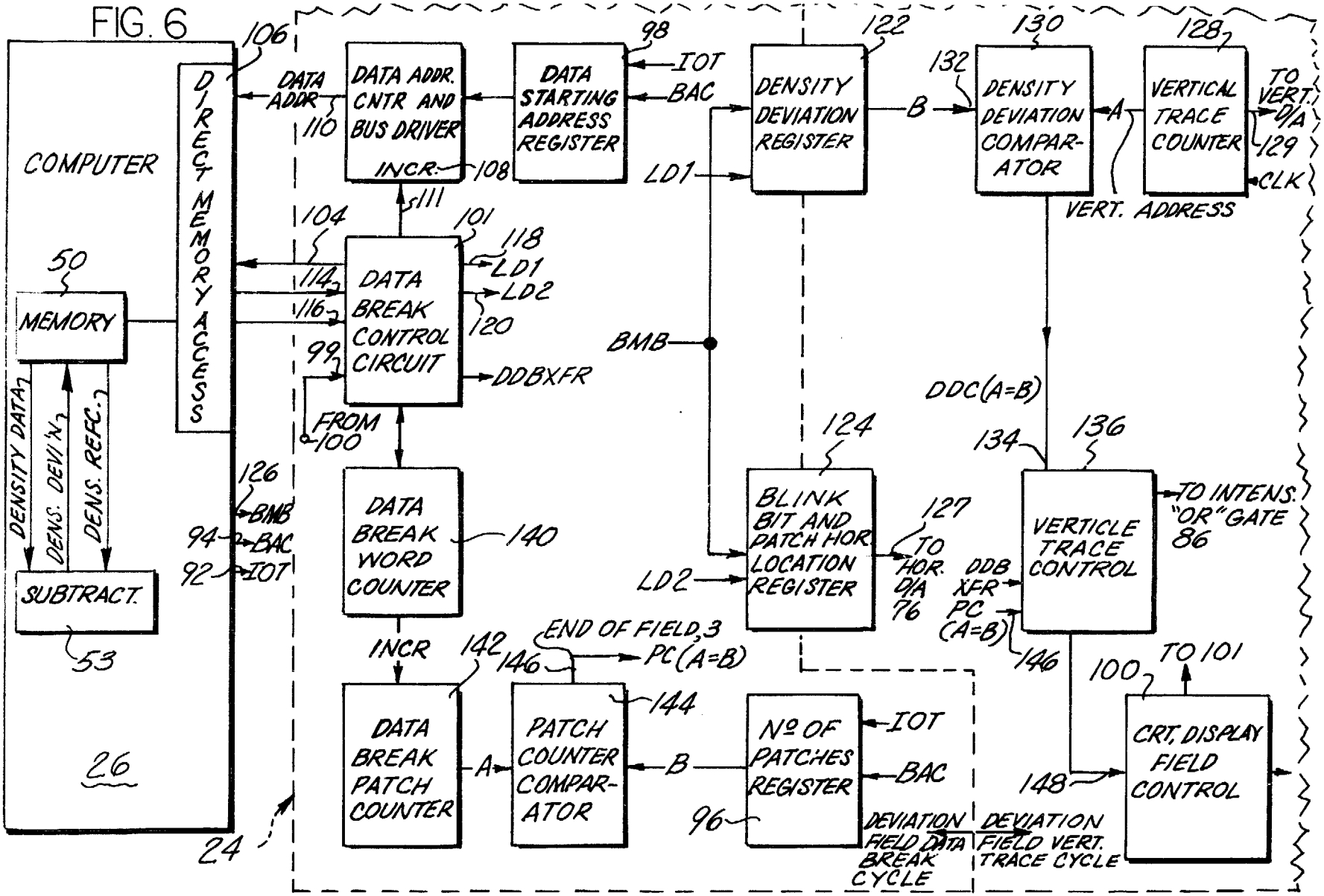
FIG. 6 is a block diagram of electronic equipment for producing the ink density deviation display.

The density deviation dot portion of the lower display 54 is produced with the aid of equipment shown in the block diagram of FIG. 6. Briefly stated, this display is accomplished by directing the beam horizontally to a position on the CRT corresponding to the first test patch location, and sweeping the beam downward with the beam blanked off, starting at a position somewhat above the upper calibration line 62, until the vertical position of the beam corresponds with a measured deviation for the patch in question. Thereupon, the beam is gated on to produce a spot, after which the beam is moved horizontally to the second patch location and the process is repeated for that patch. This display process will now be described in greater detail.

In advance of operating the printing press, setup information is entered into the memory 50 of the computer 26, including the following: (a) assignment of test patch locations to a printing unit, (b) a density set point for each test patch, (c) alarm level of density deviation for each test patch, (d) lateral location of each densitometer head 30, and (e) circumferential flash point location for each densitometer head 30. The manner in which the data are entered is described in more detail hereinbelow in connection with the description of the setup panel 28.

The computer 26 employs a programmed data transfer mode in order to load data from the computer memory 50 into certain registers shown on FIG. 6. Signals are transmitted from input/output transfer (IOT) terminals 92 and from buffered accumulator (BAC) terminals 94 to load two registers 96 and 98, in a programmed data transfer mode. The register 96 stores the number of test patches that are printed by the printing unit which has been selected for display, i.e., how many density deviation displays are associated with the selected printing unit. The register 98 is a data starting address register which indicates where the information relating to the selected printing press unit is located in the computer's memory 50. The computer 26 contains a table having the information that is necessary for the density deviation display. After the programmed transfer, the density deviation data display is initiated by a signal on a terminal 99 from a CRT display field control circuit 100. This signal represents a vertical trace transfer signal from the CRT display field control circuit 100, which merely multiplexes the oscilloscope in a repeating sequence to the key display, the calibration lines display and the data density deviation display. The signal on the terminal 99 is received by a data break control circuit 101 to indicate that the vertical trace is to be transferred from its second display function, which displays the horizontal calibration lines, to the third display function, namely the density deviation dot display.

Before each density deviation dot is produced on the CRT, it is necessary for the circuits of FIG. 6 to extract from the computer's memory information giving the proper coordinates on the CRT face of that particular dot. For purposes of extracting this information the computer is stopped for about 4 microseconds in a "cycle stealing" routine prior to production of each of the density deviation dots. The data break control circuit 101 initiates a data break request in a manner which is well known in the computer art, and transmits the request to the computer 26 on a break request line 104. The line 104 is connected to the direct memory access (DMA) portion 106 of the computer 26.

Information regarding the data starting address for the selected printing unit is transmitted from the data starting address register 98 to a data address control and bus driver circuit 108, and from there to the DMA on a data address line 110. The data address counter 108 is incremented by the data break control circuit 101 on a control conductor 111 once for each patch display, to access the appropriate patch data in the computer 26. When the address data has been accepted by the computer 26, the computer transmits a signal indicating the acceptance on a line 114, which connects to the data break control circuit 101. Timing signals are also transmitted from the computer to the data break control circuit 101, by means of lines 116.

A group of data associated in the memory 50 with each test patch contains two words of data that were previously calculated by the computer. The first word is the horizontal location of the test patch and the second is the density deviation. Load commands are produced on output lines 118, 120 of the data break control circuit 101 for loading the density deviation data and the patch horizontal location data into a density deviation register 122 and a patch horizontal location register 124 respectively. An appropriately timed signal on a buffered memory buffer (BMB) terminal 126 of the computer 26 assists in loading the data.

The contents of the patch horizontal location register 124 are connected on a line 127 via the static multiplexer 95 to the horizontal D/A 76, whose output signal places the CRT beam at a horizontal postion representing the patch's lateral location, directly below the key setting display for keys which affect that patch, (FIG. 4).

The data break control circuit 101 produces a data break transfer signal to start the counting of a vertical trace counter 128, whose output on a line 129 has been statically multiplexed into the vertical D/A 82 of FIG. 4 to control the Y coordinate deflections of the CRT beam for the first patch. The vertical trace counter 128 is driven by clock pulses so as to produce a downward sweep of the CRT beam from a predetermined starting point above the highest of the three horizontal calibration lines. The beam path scans downward but does not produce a trace on the CRT because the beam is blanked off at this time.

The vertical trace counter portion 128 of the vertical scanning apparatus just described has its output connected also to a density deviation comparator 130, FIG. 6, whereby the density deviation comparator is informed of the vertical address of the blanked CRT beam path. A second input 132 to the density deviation comparator 130 receives a density deviation signal from the density deviation register 122, this signal having been derived by the computer 26 from a recent data reading in combination the stored data set point for the patch. When the comparator 130 senses equality of its two input signals, namely the density deviation and the vertical sweeping staircase, it transmits a pulse to an input terminal 134 of a vertical trace control circuit 136, which is a logic gate circuit. One output of the vertical trace control circuit 136 connects with a third input of the OR circuit 86 of FIG. 4 so that the CRT beam is turned on to produce a bright spot 137 on the CRT face, FIG. 5, at the current address of the CRT beam. The vertical location of the spot 137 with respect to the zero deviation line 56 indicates the density deviation of that patch from its stored set point. Production of the spot 137 completes the display routine for the corresponding test patch. Data for the next test patch are then accessed from the computer 26, and the foregoing steps are repeated at a new horizontal location on the CRT for the next patch to produce the next dot 60.

The display of density deviation dots continues until a data break word counter 140, which is responsive to the data break control circuit 101 to count all words and produce only one output pulse per patch, has incremented a data break patch counter 142 sufficiently to match the number of patches stored in the number-of-patches register 96. Following the display of the data density deviation dot for the last of the patches that are associated with the selected printing unit, a patch count comparator 144 senses coincidence of the contents of the data break patch counter 142 and the number-of-patches register 96, and produces an "end of field three" signal at a conductor 146, which is connected to the vertical trace control circuit 136. This action initiates a signal on an output line 148 from the vertical trace control circuit 136 which signifies to the CRT display field control circuit 100 that the data deviation display, i.e. field three, has been completed so that the CRT beam may be transferred from those duties to the upper key setting display again.

Commonplace design details that are very well known, such as counter resets and presets and sequence timing, are omitted from this description for clarity.

EQUIPMENT OPERATION

Although the design of equipment for entering set point data and other information into the computer and methods of operating the equipment as a whole require only ordinary skill in the electronic arts, they are described briefly hereinbelow. To operate the system the operator first inserts information at the setup panel 28, FIG. 7. Thereafter he performs most of the necessary operations at the run and display panel 26 of FIG. 3 while the press is running.

A typical sequence of operation of the apparatus starts with placing a key-operated switch 152 in a "Setup Enable" position 152*a* receive input information. A column 154 of pushbutton switches is provided for selecting a setup function. Left hand and right hand keyboards 156, 158 respectively and their respective display windows 160, 162 are for entering and indicating corresponding pairs of numbers that are related to the various setup functions, as will be illustrated hereinbelow. These keyboards and a load pushbutton switch 164 for transferring entered data into the computer 26 are used in common for all of the setup functions.

To illustrate the setup routine, a "Head, Position" switch 166 is selected, an identifying number for a particular one of the densitometer heads 30 is entered into the left hand keyboard 156 and the desired lateral location of that densitometer head is entered into the right hand keyboard 158; this information is transferred to the computer by the load switch 164.

A "Channel, Unit" switch 168 is actuated when the operator wishes to enter data assigning densitometer channels to printing units of the press. Density set points are entered in the left hand keyboard, after a "Channel, Density" switch 170 has been actuated. Density alarm limits representing density deviations beyond which density alarm indicator lights start to blink are entered after actuating a "Channel, Alarm" pushbutton switch 172.

Figure 7:
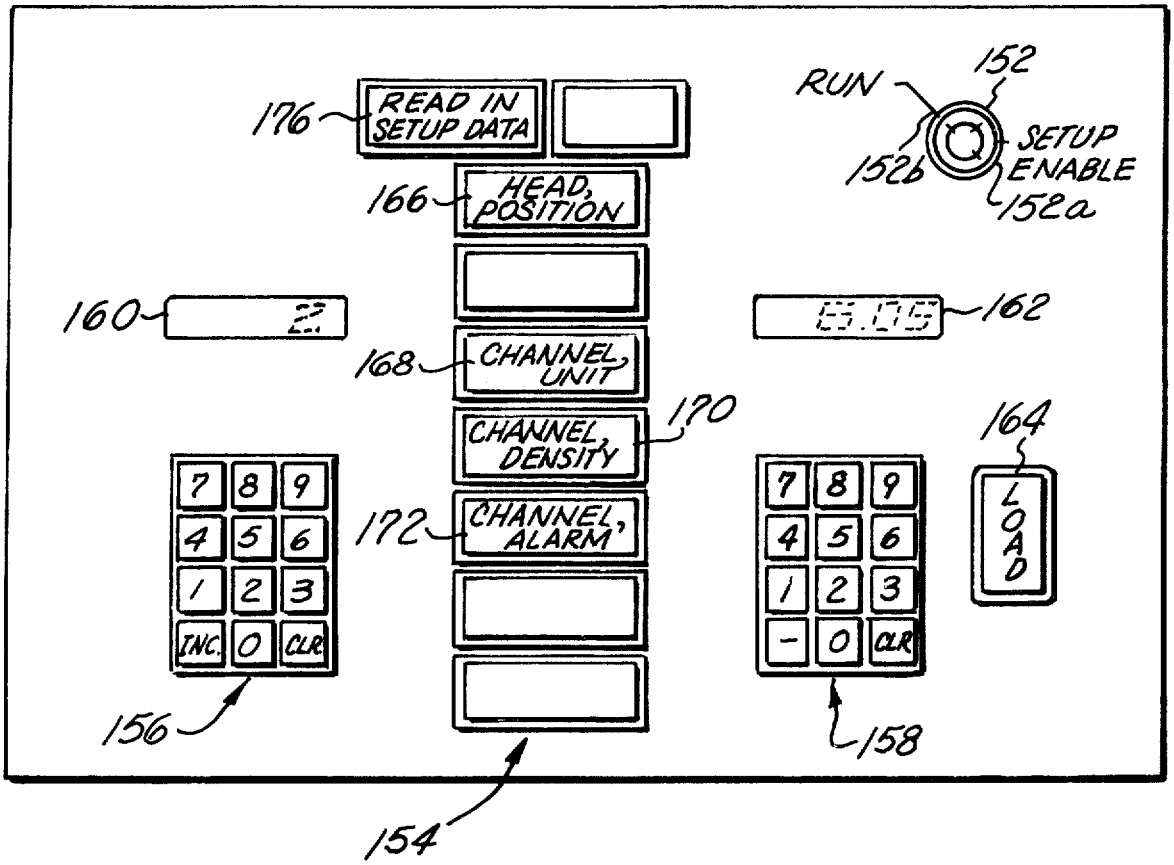
FIG. 7 is a setup panel for such purposes as pre-setting data into the system prior to running of the printing press.

Alternatively, the setup data can be entered from a punched paper tape or other such storage file by depressing a "Read In Setup Data" pushbutton 176, FIG. 7, after which density set points, etc. may be entered from the tape 29.

To operate the equipment after the setup has been completed the operator places the key switch 152 in a Run position 152b to disable the setup panel 28 and enable the run and display panel 24, FIG. 3. To operate the Run and Display panel 26 the operator selects a printing unit whose variables he wishes to display by depressing one of five pushbutton switches 178. The particular printing unit that is thus selected is connected to the display CRT 45, to most of the control switches of the run and display panel 24, and to the individual ink key adjustment switches 34 on the inspection table 22.

A column 180 of rocker switches on the right side of the panel 24 are for performing various functions for the selected unit. For example, a "Key Display" switch 184 is placed in one of its two positions to establish the range and gain of the key position display 44 such that each minor dot of each vertical key display represents 0.2 milli-inch and each heavy dot represents 1 milli-inch of ductor blade opening. In the other position of the switch 184 each minor dot represents 0.5 milli-inch of ductor blade opening and each heavy dot represents 2.5 milli-inch. In a similar way a "Density Display" switch 186 adjusts the density deviation display range and gain for the lower display 54. In one position of the switch 186 the upper and lower calibration lines 62, 64 represent deviations of ±0.1 density units from the set point values of the center line 56. In its other position the lines 62, 64 represent deviations of ±0.5 density units from the set points.

A "Density Set Point" register 188 displays the density set point of the density channel that is currently selected by a Patch Selector switch 189, and a rocker switch 190 is provided for decreasing and increasing the set point of the selected channel. In a similar manner alarm limits are displayed and adjusted by a register 192 and a switch 194.

A dual purpose display has been described in which for a selected printing unit the settings of all of the ink keys 32 are displayed as a vertical row of dots and a final interpolation dot, on an upper display 44 of a CRT 43, and the density deviations of densitometer channel readings that were assigned to that particular printing unit are simultaneously displayed on a second display 54 on a lower portion of the same CRT, with the density deviation displays being laterally aligned directly below displays for the ink keys that most effectively contribute to their density readings.

What is claimed is:

1. Display apparatus for a printing press having a plurality of ink rate control devices distributed laterally across the press and having equipment for producing indicating signals having values in accordance with the settings of respectively associated said ink control devices and having at least one ink density measurement system for making a measurement of printed ink density as established by at least some of said devices comprising display means including means responsive to said indicating signals for displaying visual representations as to the values of respectively associated said signals in a linear array of visual displays of the settings in the order in which the ink control devices are laterally distributed across the press, reference means operable for setting an ink density reference level, comparator means responsive to said ink density measurement and said ink density reference level for producing a density deviation signal in accordance with the difference between them, and said display means including means for displaying a visual representation of said deviation signal in geometrical alignment with and for visual association with those ones of said array of displays of ink control device settings by which said ink density is established.

2. Display apparatus for a printing press as defined in claim 1 and wherein said means for displaying said settings of said ink control device and said deviation display means comprise cathode ray tube display means, and said visual displays of settings are arrayed horizontally, and said deviation signals are displayed in vertical alignment with the display of the device settings that are associated therewith.

3. Display apparatus for a printing press as defined in claim 1 and wherein said press comprises a plurality of said ink density measurement systems, and comprises a like plurality of said reference means and of said comparator means, and wherein said deviation display means comprises means for displaying a plurality of deviation signals each corresponding respectively to one of said density measurement systems, each of said deviation signal display being in geometrical alignment for visual association with those ones of said array of displays of ink control device settings by which the respective ink density is established.

4. Display apparatus for a printing press as defined in claim 1 and wherein said printing press has a plurality of printing units and wherein said ink density measurement system is provided for use by a plurality of the printing units, and further comprising switching means for selectively connecting said means for displaying settings and said deviation display means for use by one at a time of said printing units.

5. Display apparatus for a printing press as defined in claim 1 and wherein said means for displaying each of said visual displays of ink control device settings comprises means for displaying indicators at equally spaced positions extending in a vertical column from a predetermined starting point, whose last indicator position of said column is proportional to said setting except when said setting corresponds to a vertical postion intermediate said equally spaced positions, and further comprises means for producing an interpolation indicator as the last indicator in said column to indicate said setting when said setting corresponds to a vertical postion intermediate said equally spaced positions.

6. Display apparatus for a printing press having a plurality of ink rate control devices distributed laterally across the press and having equipment for producing indicating signals having values in accordance with the settings of respectively associated said ink control devices and having at least one ink density measurement system for making a measurement of printed ink density as established by at least some of said devices comprising display means including means responsive to said indicating signals for displaying visual representations as to the values of associated said indicating signals in a linear array of visual displays of the settings in the order in which the ink control devices are laterally distributed across the press, said display means including means for displaying said plurality of visual representations as a plurality of vertical columns of equally spaced apart indicators with each said column being associated with one of said ink control devices, said indicators of each column extending from a horizontal base line and extending in a first direction therefrom with the number of said indicators in a given column being dependent on the value of the indicator signals for the ink setting of an associated said ink control device, reference means operable for setting an ink density reference level, comparator means responsive to said ink density measurement and said ink density reference level for producing a density deviation signal in accordance with the difference between them, and said display means including means for displaying a visual representation of said density deviation signal in geometrical alignment with and for visual association with those ones of said array of displays of ink control device settings by which said ink density is established.

7. Display apparatus for a printing press having a plurality of ink control devices distributed laterally across the press and having means for producing a like plurality of indicating signals having values in accordance with settings of respectively associated said ink control devices and having a plurality of ink density measurement systems each for making a measurement of printed ink density as established by at least some of said devices comprising display means including means responsive to said indicating signals for displaying visual representations as to the values of associated said indicating signals and including means for displaying said plurality of visual representations as a plurality of vertical columns of equally spaced apart indicators with each said column being associated with one of said ink control devices, said indicators of each column extending from a horizontal base line and extending in a first direction therefrom with the number of said indicators in a given column being dependent on the value of the indicator signal for the ink setting of an associated said ink control device so that the last indicator of said column is spaced from said base line by a distance proportional to the setting of the associated ink control device except when the setting thereof corresponds to a vertical position intermediate said equal spacings, means for producing an interpolation indicator as to the last indicator in a said column to indicate said setting when said setting corresponds to a vertical position intermediate said equal spacings, reference means for setting an ink density reference level, comparator means responsive to said ink density measurement and said ink density reference level for producing a density deviation signal in accordance with the difference between them, and said display means including means for displaying a visual representation of said density deviation signal in geometric alignment with and for visual association with those ones of said array of displays of ink control device settings by which said ink density is established.

* * * * *